US006571918B1

(12) United States Patent
Cotler

(10) Patent No.: US 6,571,918 B1
(45) Date of Patent: Jun. 3, 2003

(54) LIQUID PUMP AND METERING APPARATUS

(75) Inventor: Elliot M. Cotler, Brooklyn, NY (US)

(73) Assignee: Uniwave, Inc., Farmingdale, NY (US)

( * ) Notice: Subject to any disclaimer, the term of this patent is extended or adjusted under 35 U.S.C. 154(b) by 0 days.

(21) Appl. No.: 09/624,090

(22) Filed: Jul. 24, 2000

(51) Int. Cl.[7] ..... F16N 27/00
(52) U.S. Cl. ..... 184/7.4; 184/33; 184/35
(58) Field of Search ..... 184/6, 7.1, 7.4, 184/31, 33, 35; 66/8

(56) References Cited

U.S. PATENT DOCUMENTS

| | | | | |
|---|---|---|---|---|
| 1,500,361 A | | 7/1924 | Brockway | |
| 1,805,609 A | | 5/1931 | Wilson | |
| 2,254,274 A | | 9/1941 | Doe | 221/95 |
| 4,205,708 A | | 6/1980 | Burgbacher | 139/1 R |
| 4,291,724 A | * | 9/1981 | Miller | 137/555 |
| 4,719,768 A | * | 1/1988 | Lonati | 66/8 |
| 4,792,099 A | * | 12/1988 | Hatch et al. | 241/30 |
| 5,154,259 A | | 10/1992 | Magome | 184/7.4 |
| 5,181,585 A | | 1/1993 | Braun et al. | 184/7.4 |
| 5,291,970 A | | 3/1994 | Vinciguerra et al. | 184/11.2 |
| 5,513,964 A | | 5/1996 | Rockwood | 417/423.13 |

* cited by examiner

*Primary Examiner*—David Fenstermacher
(74) *Attorney, Agent, or Firm*—Schweitzer Cornman Gross & Bondell LLP

(57) ABSTRACT

An apparatus for delivering metered amounts of a first fluid, such as a lubricating oil, to a remote location comprises a metering plate coupled to a drive for moving the metering plate between a first position in which a fluid receptacle in the metering head is filled with the fluid and a second position in which the filled receptacle is placed between first and second ports for transfer of the fluid into and through a delivery line. The first port provides a source of a carrier fluid to drive the first fluid, while the second port is coupled to a delivery line to the remote location. The first and second ports form a portion of a manifold assembly, which in conjunction with the metering plate comprise a metering head. The metering head may be submerged in a reservoir of the first fluid such that, in the first position, a receptacle is directly exposed to the reservoir whereby the receptacle is filled with a first fluid without the need for pumps or pressurization of the reservoir.

22 Claims, 12 Drawing Sheets

FIG. 3D
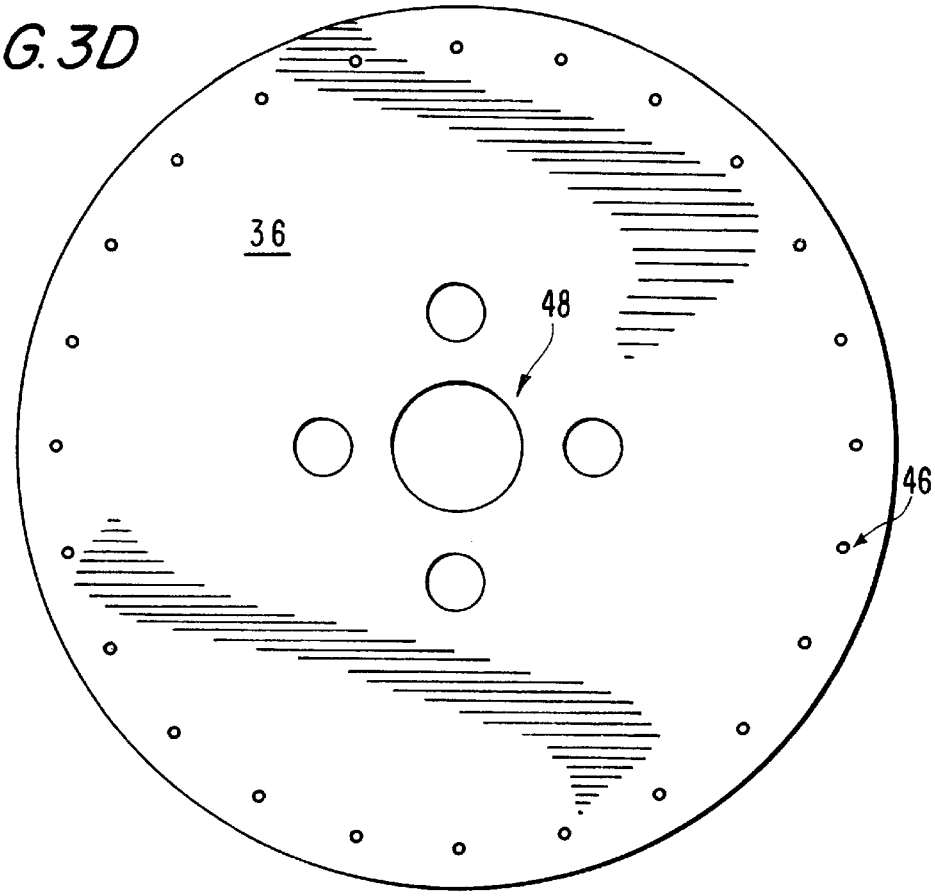
FIG. 4
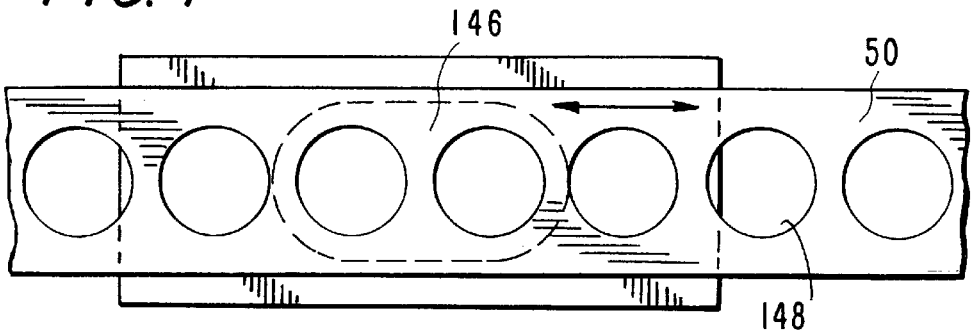
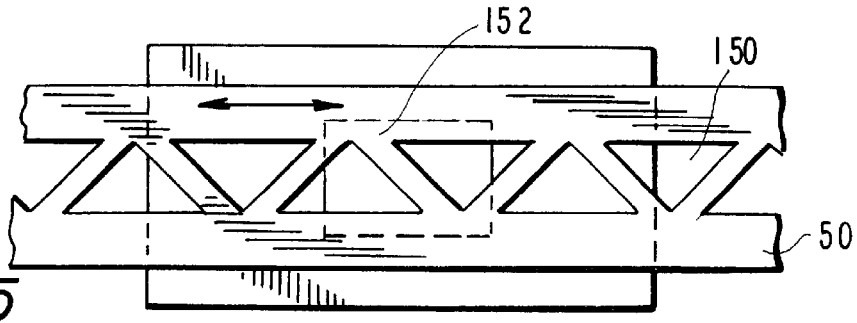
FIG. 5

LIQUID PUMP AND METERING APPARATUS

The present invention relates to a new and improved apparatus for the metering and dispensation of measured volumes of liquid, and has particular utility with respect to the metering and dispensation of oil and similar lubricants.

BACKGROUND OF THE INVENTION

Industrial machines often require a continuous lubrication of joints and elements during operation. In textile machinery such as knitting machines, for example, the needles and associated elements, such as cams, sinkers and the like, must be continuously lubricated. Lubricant starvation can result in component seizure or breakage, with a resulting down time of the knitting apparatus, and/or the incorporation of defects into the textile product being manufactured.

Knitting machine lubrication is typically performed by use of a lubricant mist generating and delivery system. Such systems deliver an air/lubricant mist, either on a continuous or intermittent basis, to the intended locations in the knitting machine apparatus. Control over the amount of lubricant is important. Too little lubricant can result in system overheating and failure, while over-lubrication is both wasteful of the lubricant and can result in excessive spotting and soiling of the knitted fabric. In addition, the presence of excess lubricant can lead to the entrapment of dust and lint, and can thus also lead to machine damage and/or failure.

Modern oil mist systems are capable of providing a generally constant delivery of lubricant in relatively minute amounts, and can provide transmission to multiple lubrication points for complex systems. Typical lubricators can carry from eight to twenty-two lubrication lines. As they have few moving parts, such systems have extended life spans.

These benefits, however, have an associated cost. Compressed air is the source of energy utilized to break the oil into a mist and to carry the mist to its destination. The compressed air must be clean and dry and the lubricant oils should be of a certain minimum quality. Some high viscosity oils are hard to break into a mist and require an elevated level of air pressure. Further, the output of such lubricant systems is dependent on oil viscosity and the number of lubrication lines, so the system must be carefully configured for the oil used and the number of active lines. The subjecting of the oil to a stream of pressurized air can place a significant strain on oil anti-oxidant additives which are present in the oil along with corrosion inhibitors which are needed to protect the machinery. Most lubricants formulated for textile machinery are water soluble, which requires control over the moisture content of the incoming air. Excessive moisture and pressure differences which may develop in a high pressure system can result in water precipitation, the water mixing with the oil to form soapy complexes inside the lubricator. Extreme care must be observed to prevent such sludge from clogging the oil passages.

It is accordingly a purpose of the present invention to provide an oil delivery apparatus which may be used in conjunction with previously-developed mist-type lubrication nozzles which avoid many of the shortcomings of the prior art. In particular, a lubrication apparatus in accordance with the present invention can generate continuous flows of carefully and precisely metered oil droplets at a relatively low air pressure. Lubricant distribution and spray nozzle operation can be sequenced in an efficient and convenient manner, without the requirement for further complex diverter-type devices. The present invention can operate over a wide range of lubricant densities, including extra heavy lubricants that normally cannot be applied by mist lubrication distribution systems. The construction of the apparatus prevents contact between the oil reservoir and an increased air pressure, minimizing the likelihood of oil oxidation and aeration inside the reservoir. Further, the present system does not require system halt or disassembly to refill the reservoir.

BRIEF DESCRIPTION OF THE INVENTION

In accordance with the foregoing and other objects and purposes, a fluid metering apparatus for use in conjunction with lubricant distribution systems and fluid dispensation systems in accordance with the present invention utilizes an unpressurized reservoir of a first fluid to be dispensed, such as lubricant, into which a metering. and distribution head is submerged. The head comprises a pair of spaced headers or manifolds through which extend one or more pairs of aligned ports or bores. Each port pair may be associated with a separate distribution line to deliver metered portions of the first fluid to a particular location. Positioned for travel within the space between the two manifolds are metering means having a series of receptacles for the first fluid extending between surfaces of the metering means. The metering means and receptacles may take the form of a plate having a series of precisely-dimensioned apertures extending between surfaces of the plate, the plate being connected to plate drive means. The drive means alternatively exposes a receptacle of the metering means to the first fluid, allowing a precise volume of the fluid to fill the receptacle aperture, and places the aperture into alignment with a port pair in the manifolds. A compressed or pressurized carrier or drive fluid, such as compressed air, supplied to a first port of a port pair, dislodges the entrapped volume of first fluid from its aligned aperture receptacle, and drives the first fluid into the second port of the pair and through the associated distribution line for transmission to the intended target. The drive means subsequently passes the empty receptacle past the port pair, re-exposing the receptacle to the first fluid, whereby the receptacle is refilled. A following passage of the aperture between a pair of ports allows dispensation of the new volume. The process continues on a repeating basis.

In a preferred embodiment of the invention useful for lubricant dispensation the metering means may take the form of a disk having a plurality of receptacle apertures rotating between the two manifolds. Each manifold is provided with a plurality of ports allowing the simultaneous dispensation of lubrication for a plurality of distribution lines and targets.

BRIEF DESCRIPTION OF THE DRAWINGS

A fuller understanding of the present invention will be obtained upon consideration of the following detailed, but nonetheless illustrative embodiments of the invention, when reviewed in connection with the annexed drawings, wherein:

FIG. 3D is a top plan view of yet another form of metering plate;

FIG. 4 is a depiction of an alternative construction for a metering plate and manifold;

FIG. 5 is a depiction of a second alternative construction therefor;

DETAILED DESCRIPTION OF THE INVENTION

Figure 1:
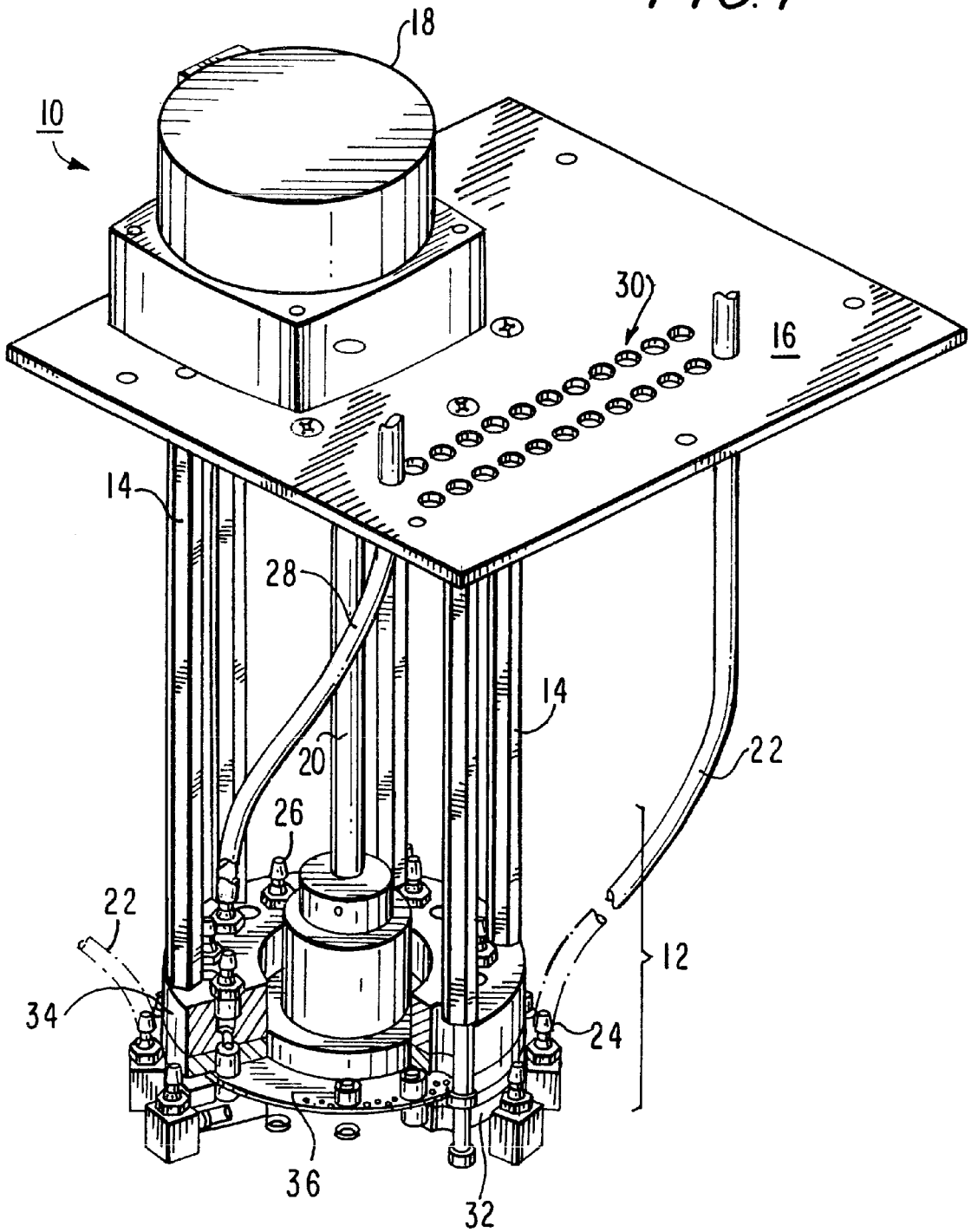
FIG. 1 is a perspective, partially cut-away view of a preferred embodiment of the invention.

With initial reference to FIG. 1, a liquid metering apparatus 10 constructed in accordance with the present invention comprises a metering head 12 supported by a plurality of legs 14 from a top plate 16. Top plate 16 may be dimensioned and constructed to rest across an open top of a lubricant container, such as a drum (not shown), or may be otherwise supported or mounted thereto, with the metering head being submerged in a reservoir of lubricant within the container. The top plate 16 further supports a motor drive unit 18 whose output shaft is coupled to the metering head 12 by a vertically-extending transmission 20. A plurality of compressed gas inlet lines 22 are coupled to corresponding inlet barbs 24 in an inlet port manifold 32, while outlet barbs 26 in an outlet port manifold 34 are connected to gas/lubricant outlet lines 28. Both the inlet and outlet lines 22, 28 may be directed through appropriate bores 30 in the top plate 16 to exit the lubricant container for routing purposes. Compressed air from an appropriate compressor and/or reservoir may serve as the compressed gas carrier fluid.

The manifolds 32, 34 are positioned in a vertically-spaced arrangement, with a metering plate 36 being located therebetween. The metering plate 36 may be in the form of a disk having apertures which function as receptacles for the lubricant, entrapping measured amounts of lubricant and passing the entrapped lubricant between aligned bores in the manifolds. The entrapped lubricant is then driven from the metering disk by the compressed air from an inlet line 22 and inlet port through an outlet port and an outlet line 28. Metering plate 36 is rotated by motor drive 18 and transmission shaft 20.

Figure 2:
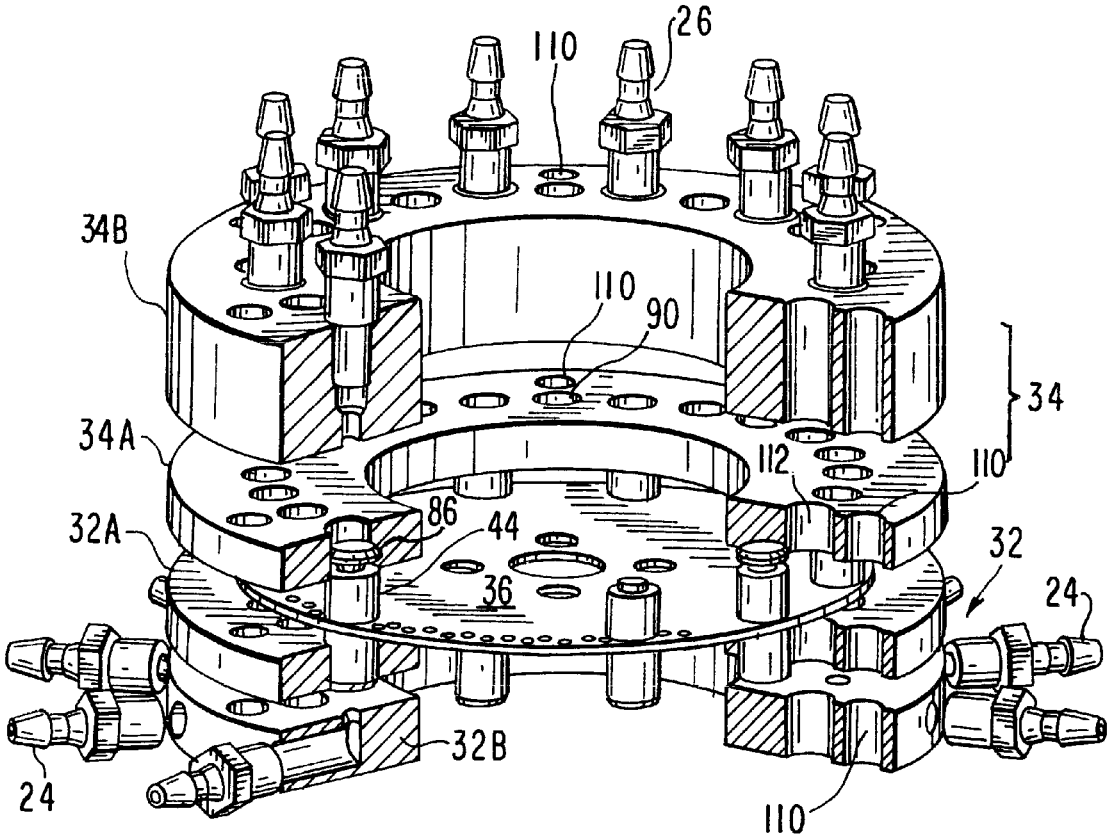
FIG. 2 is a detailed partial perspective exploded view of the manifolds and metering means of the invention as shown in FIG. 1, presenting an alternative construction for inlet barbs.
Figure 2A:
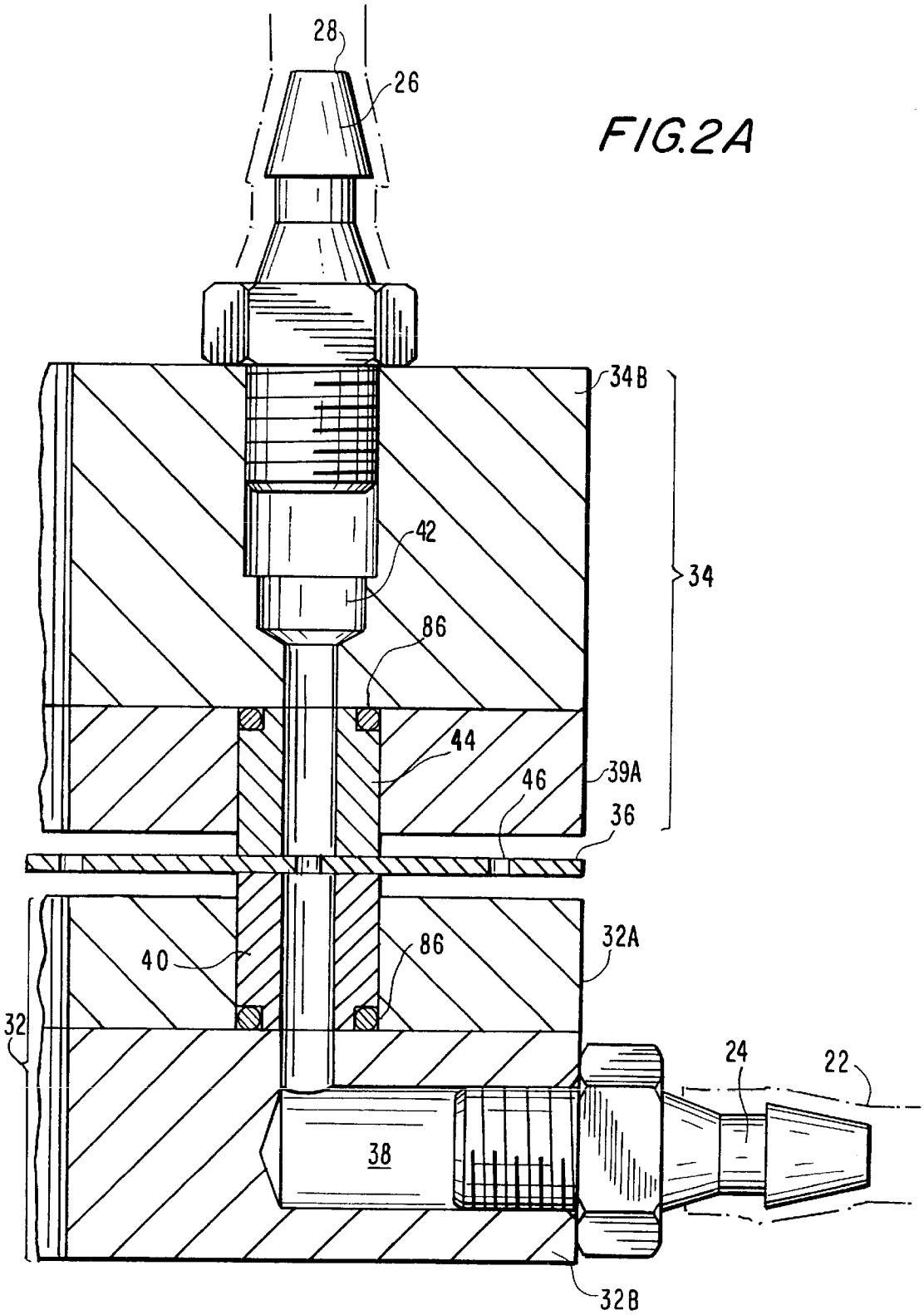
FIG. 2A is an elevation view in section of the portion of the invention as depicted in FIG. 2.

FIGS. 2 and 2A detail a metering head 12. As shown therein, each of the inlet and outlet manifolds 32, 34 may be of a ring-like construction, each having a first outer or external ring 32B, 34B and a second inner or internal ring 32A, 34A, respectively. The inlet manifold 32 has a series of inlet port passageways for the drive fluid, such as compressed air, each of which may include a right angle passageway portion 38 in ring 32B which couples an air inlet line 22 and inlet barb 24, which is threaded into ring 32B, to a fitting 40 which extends upwardly from and is supported by an aligned passageway portion in ring 32A. Similarily, the outlet manifold 34 has a series of outlet ports for the lubricant and compressed gas, each of which includes passageway portion 42 in ring 34B, which couples an outlet barb 26 and air/lubricant outlet line 28 to a fitting 44 which extends downwardly from and is supported within the aligned passageway portion in the ring 34A. As may be seen, the fittings 40, 44 extend beyond the facing surfaces of the corresponding manifold rings 32A, 34A, their exposed end faces engaging in a frictional contact with the opposed faces of metering plate disk 36. Each of the fittings 40, 44 may be constructed of a high-molecular weight plastic, such as DELRIN, in order to provide a sliding sealing contact with the metering plate 36. An O-ring seal 86 is provided on each fitting and port to seal the fitting against the rings of the manifold.

The manifolds are kept in alignment and register by use of bolts or the like in bores 110 in the manifold rings as seen in FIG. 2. Preferably, the bolts support, or are formed as the lower portions of, the legs 14. The manifolds are bolted together, the O-ring seals 86 providing a resilient bias and seal for the fittings 42, 44 against the metering plate disk 36. Other biasing means may also be used to seal the fittings against the disk, such as a spring assembly between the manifolds and a retention plate, or individual springs for the fittings. A further series of bores 112 may be provided in the upper manifolds to allow air bubbles to vent up through the lubricant from between the manifolds.

Figure 3:
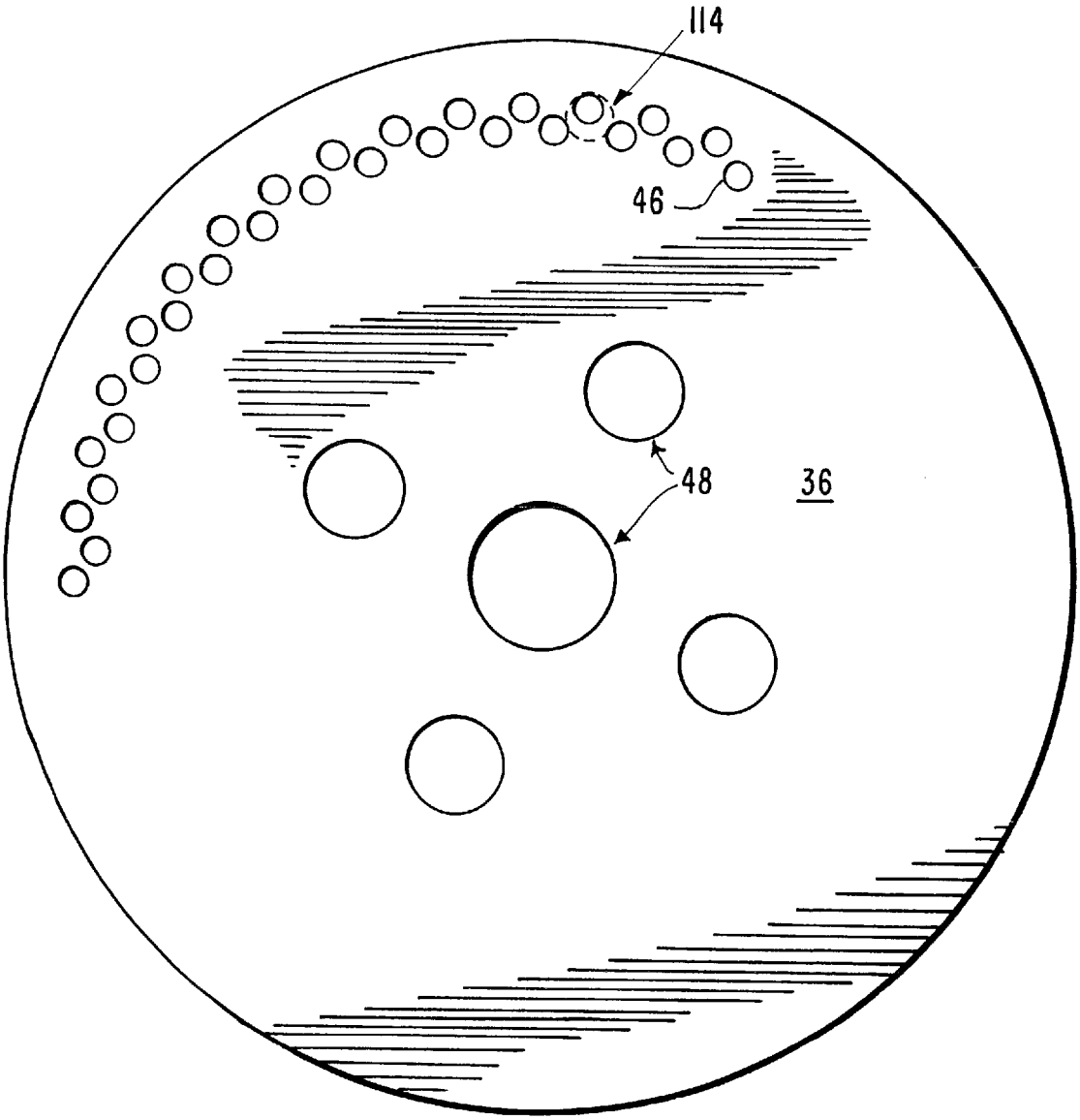
FIG. 3 is a top plan view of a metering plate.

As shown in FIG. 3, the metering plate disk 36 may contain receptacles for the lubricant in the form of a series of apertures or throughbores 46 extending between the top and bottom surfaces of the plate and located in a circular array capable of being aligned with one or more sets of fittings in the manifolds 32, 34. As depicted, the apertures may be arrayed in staggered order along an arc. Each of the apertures 46 is dimensioned to correspond to a discrete volume of lubricant which is intended to be transmitted through the distribution system coupled to the invention. The throughbores may be, for example, 30 in number and 0.046 inches in diameter in a disc of 0.03 inch thickness. The disk may rotate, for example, at a speed of between 1 and 3 rpm. The metering disk rotates about its center, a central aperture assembly 48 being provided to allow the disk to be connected to the transmission 20 and motor drive 18 as shown in FIG. 1.

Figure 3A:
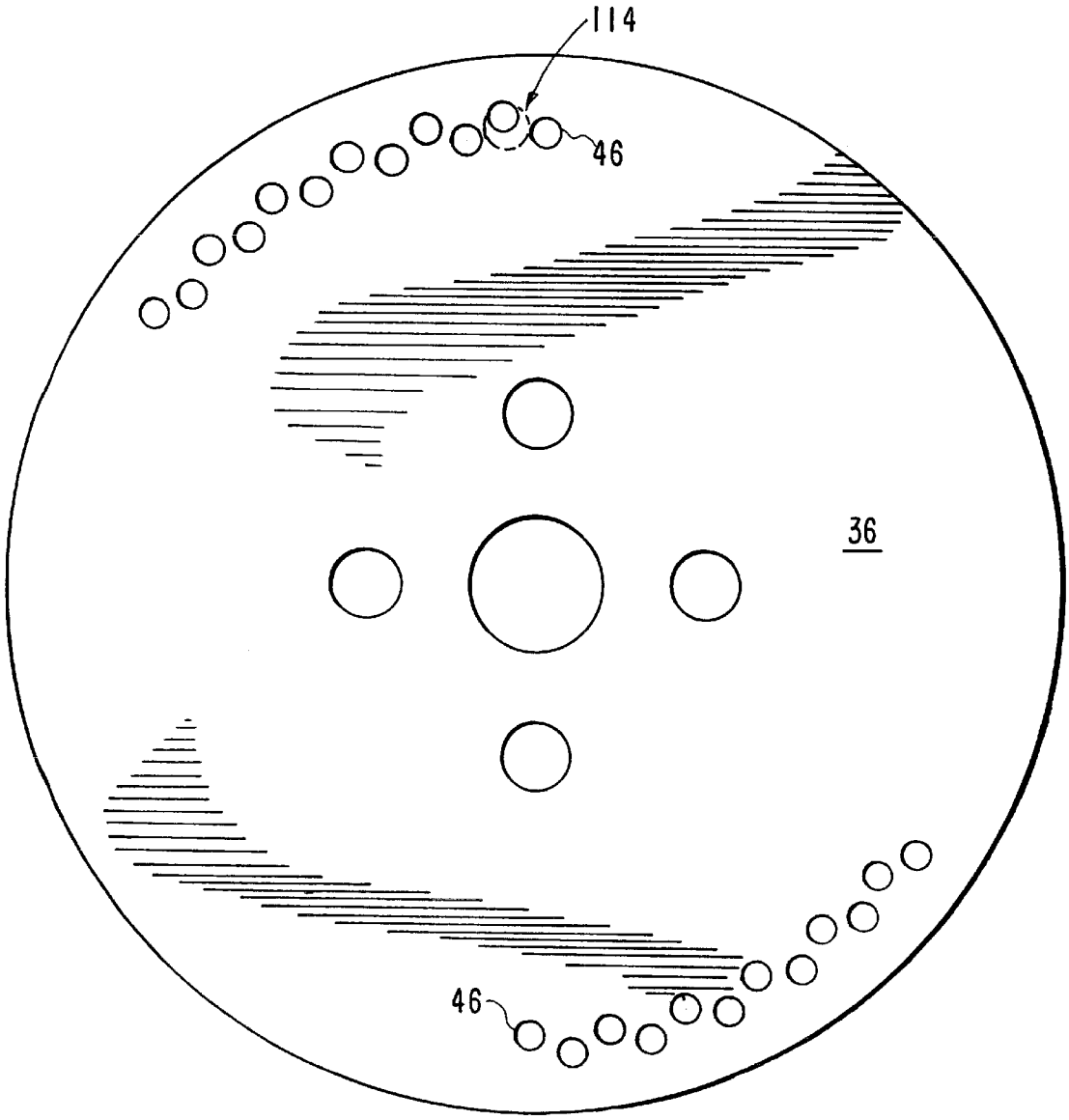
FIG. 3A is a top plan view of an alternative metering plate.

The apertures may be arranged about the full circumference of the metering plate disk, or as shown in FIG. 3, about a portion thereof. When the apertures extend about a portion of the disk, rotation of the metering plate disk also serves a sequencing function, as the apertures sequentially engage and align with only a portion of the fittings of the ports arranged about the manifolds. The apertures in FIG. 3 extend about one-third the circumference of the metering plate disk, resulting in a corresponding engagement with one-third of the outlets at any instant, with the pattern shifting along the circumference of the manifold with the rotation of the disk, allowing sequencing of lubrication to occur. Other sequencing patterns can be created by appropriate positioning of the apertures on the metering disk. For example, the apertures may be located in spaced groups, as shown in FIG. 3A, whereby a fitting pair is engaged during two intervals of a full disk rotation. This arrangement can be useful at low speed disc rotation as it lessens the period between engagement intervals.

Figure 3B:
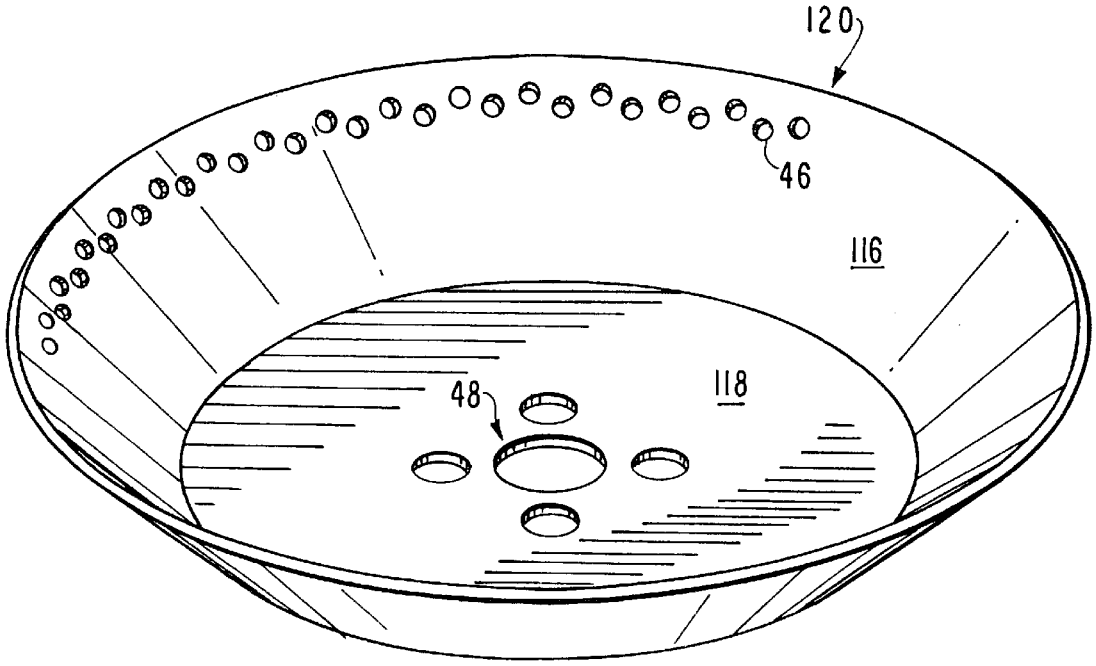
FIG. 3B is a perspective view of an alternative metering plate.
Figure 3C:
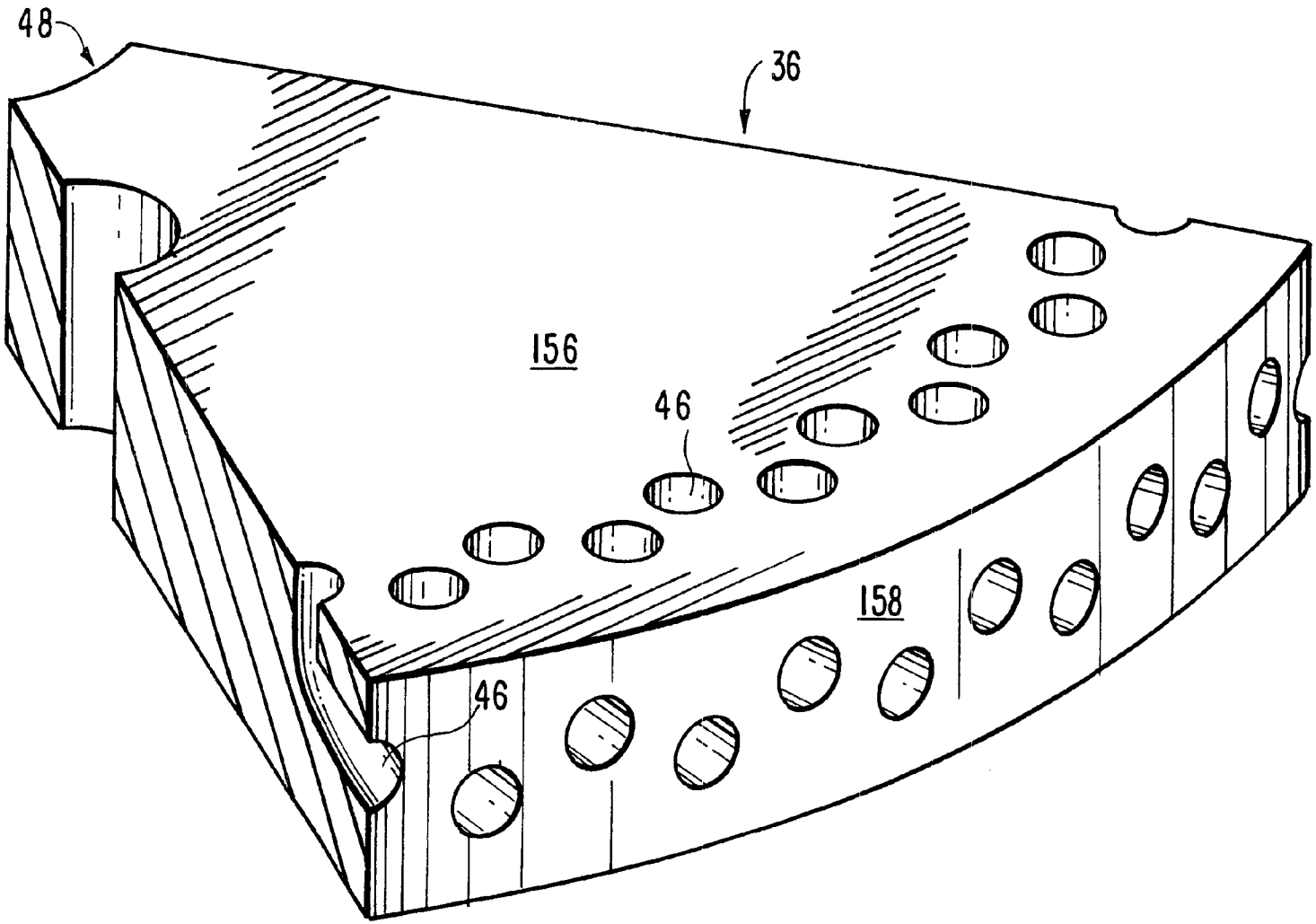
FIG. 3C is a perspective view of another alternative metering plate having a conical wall.

As seen in FIG. 3C, the apertures forming the first fluid (lubricant) receptacles need not extend between opposed top and bottom surfaces of the metering plate. If the metering plate is of extended thickness, the apertures 46 can extend between the top (or bottom) surface 156 and the edge 158, the inlet and outlet ports and manifolds being positioned to provide port contact with the aperture-containing surfaces and alignment with the apertures. It is also possible for the apertures to be of a "U" shape configuration, whereby the both termination points lie on the same metering plate surface. While the apertures are preferably of constant cross-section, they may also be formed of varying cross-sectional areas, as shown in the figure.

With further reference to FIGS. 2 and 2A, it is to be appreciated that, because the metering head is submerged in lubricant, and the metering disc plate 36 is in contact with the manifolds only by virtue of spaced pairs of port fittings 40 and 42, each of the apertures 46 is exposed to, and becomes filled with, lubricant when it is out of alignment with a fitting pair. As the metering disk plate rotates into its dwelling position, a lubricant-filled aperture comes into alignment with a fitting pair. As it becomes aligned the compressed gas carrier fluid supplied to the inlet manifold passageway drives the lubricant "slug" in the aligned disk aperture further downstream, into an outlet fitting 44, and into and through the outlet manifold into the corresponding outlet line 28. During dwell time the slug of lubricant is drawn over the inner surfaces of the downstream line and moves toward its end, which may be coupled to delivery means as known in the art. (See, e.g. U.S. Pat. Nos. 3,726,482 and 5,639,028). The combination of aerodynamic surface drag, lubricant internal viscosity, and tackiness to the walls provides for a continuous gradual delivery of the lubricant by the passing carrier fluid gas stream.

The simplest construction of a metering disc plate is shown in FIG. 3D. The apertures 46 are equally spaced along a single circle. As an aperture 46 of the pattern shown in FIG. 3D shifts out of alignment, the fittings are closed off by the body of the disk 36 and the carrier fluid flow ceases until another aperture comes into alignment. The air flow through an outlet line 28 is thus of an intermittent nature and reflects the shifting pattern of the metering disc apertures. As the metering disk shifts, each of the apertures therein is sequentially exposed to lubricant, passed between a set of fittings 40, 42, whereby the lubricant slug is removed, and then re-exposed to lubricant for refilling before it passes between a subsequent fitting set. The shifting of the apertures, controlled by motor drive 18, may be in a continuous or preferably a stepped rotational or rotary reciprocating manner where each pair of fittings is served by a group of at least one aperture. A stepped motion is preferred with the step length corresponding to the distance between fittings (or a multiple thereof) to maximize the aligned dwell time to minimize discontinuation in flow. The motor drive means may employ a controller that drives the disc in the stepped manner.

The aperture patterns shown in FIGS. 3 and 3A further allow the disk to be driven in a simple continuous rotary motion without pressure spikes during shift. With the fitting exit hole 114 internal diameter (i.d.) bigger than the metering disk aperture i.d. and the holes appropriately spaced, at any instant at least one aperture is exposed to carrier fluid flow. Use of staggered pattern of disk apertures allows for overlapping of the exit aperture 114 by successive disk apertures, thus increasing the overall alignment dwell time and further eliminating pressure spikes. With the fittings arranged in the manifolds along one or more paths aligned with that of the apertures, each fitting set is sequentially serviced by each aperture as the disk rotates. Alternatively, fittings may be arranged in concentric circular paths in the manifolds, with corresponding multiple rings of apertures in the metering disk, each ring serving only a portion of the fittings. Because the metering head is submerged in lubricant, neither separate lubricant pumping or pressurization means are required for delivery of the lubricant to the metering head and output lines. A level switch (not shown) may be utilized in the lubricant reservoir to generate an output signal when the lubricant level decreases to a point that starvation of the metering head may occur. Because the lubricant is not under pressure in the reservoir, however, reservoir refill can be performed without shut-down of the system, simply by adding additional lubricant.

While a metering head utilizing a disk-shaped metering plate as depicted in FIG. 3 is a preferred embodiment, as it allows continuous uni-directional rotation motion of the plate, alternative embodiments of the invention may utilize other plate constructions. For example, FIG. 3B depicts a metering plate 120 in the form of a truncated cone. The apertures 46 are located on the conical surface 116, which is mounted to circular plate 118 bearing the central drive aperture assembly 48. The inlet and outlet manifolds and fittings are located to engage the opposed surfaces of the conical surface 116.

Figure 6:
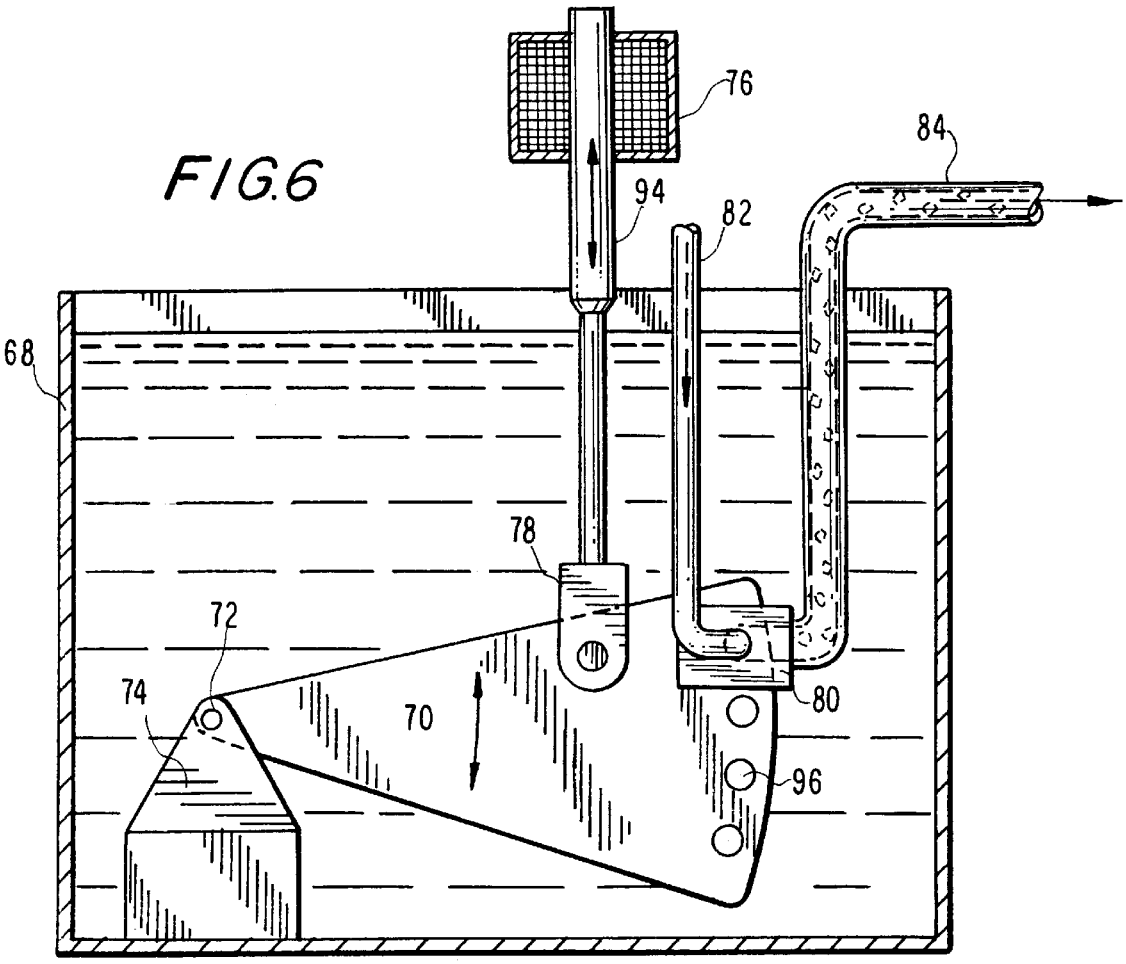
FIG. 6 is an elevation view of an alternative construction for the invention.

FIG. 6 depicts an embodiment of an oil distribution device in accordance with the present invention having a metering plate 70 in the form of a generally triangular plate pivotly mounted at 72 to an appropriate support 74 within an oil reservoir 68. Solenoid armature 94 is connected to the metering plate 70 by a clevis 78. Energization of the solenoid draws the solenoid armature 94 upward, while disenergization of the solenoid allows the armature to return to a neutral position. A return spring (not shown) may be used to drive the armature to the return position. Pulsing the power to the solenoid causes the reciprocation of the metering plate in an arcuate manner about the pivot point 72. The metering plate 70 has a series of apertures 96 located for passage between the opposite sides of a manifold assembly 80 having an inlet line 82 for the compressed gas fluid carrier and an outlet line 84 in which the lubricant and compressed gas is directed to the desired lubrication point.

Figure 8:
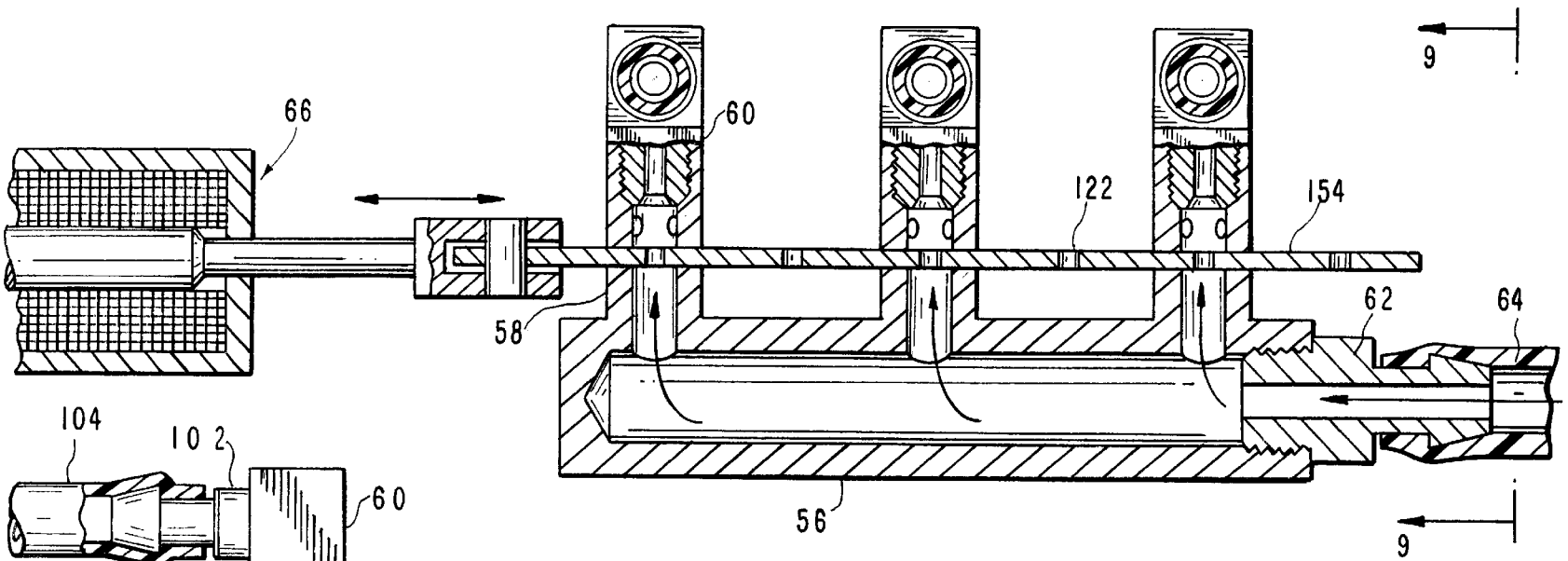
FIG. 8 is a depiction of a second alternative construction for the invention.
Figure 9:
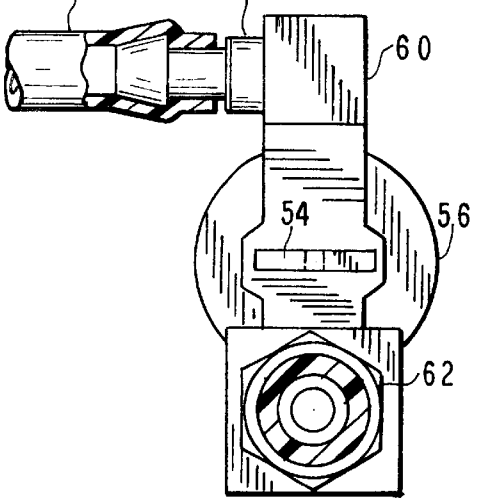
FIG. 9 is a sectional view thereof taken along line 9—9 of FIG. 8.

FIGS. 8 and 9 reflect another embodiment of the invention, in which the metering plate is in the form of an elongated strip. As shown therein, elongated metering plate 54 is located between a first, lower inlet manifold 56 having a series of spaced fitting portions 58 in alignment with corresponding upper outlet fittings 60 mounted in an appropriate manifold (not shown). Each of the outlet fittings has an outlet barb 102 coupling the fitting to an outlet line 104. An inlet barb 62 connected to inlet line 64 provides compressed gas to the lower manifold 56 and each of the fittings 58. A solenoid 66 provides a reciprocal drive for the metering plate. The plate apertures 122 and fittings are spaced, and the reciprocation distance for the solenoid chosen such that at least one aperture passes between each of the fittings for each solenoid stroke.

Figure 9A:
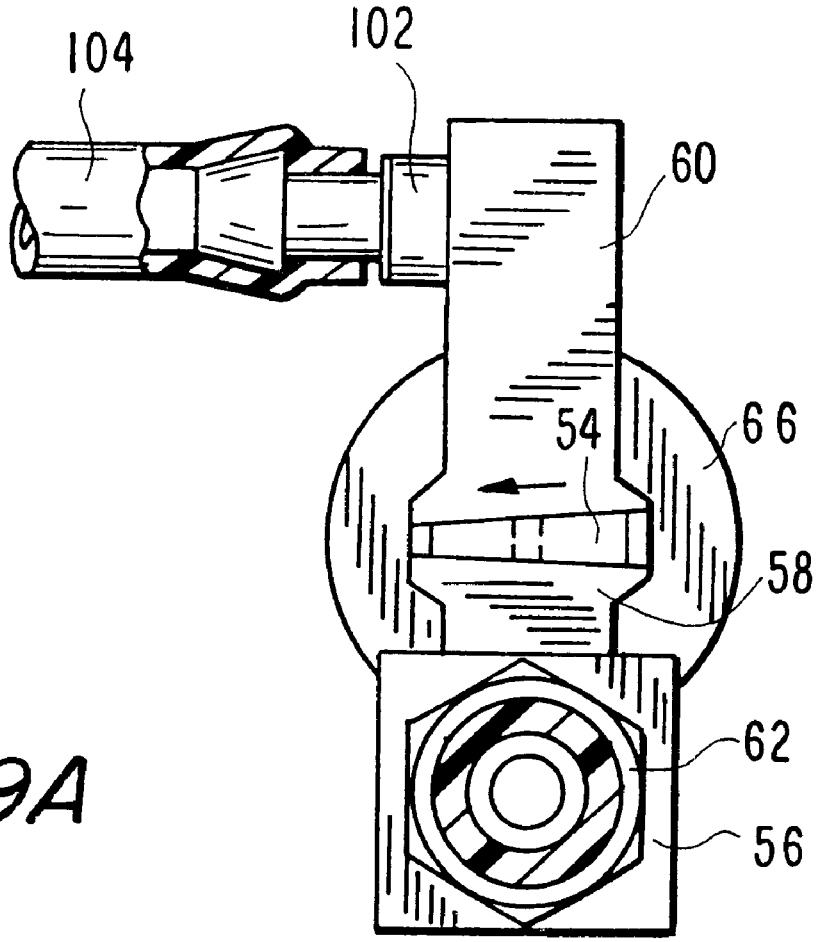
FIG. 9A is a sectional view of the alternative of FIG. 8 showing a wedge-shaped metering plate.

In each of the foregoing embodiments, the metering plate has been presented in the form of an element of constant thickness. The invention also contemplates, however, the use of variable thickness metering plates. For example, FIG. 9A shows the embodiment of FIG. 8 in which the metering plate 54 is wedge-shaped across its width. Such a wedge shape can be effective in maintaining a seal between the metering plate and correspondingly angled port pairs as the contact force between the metering plate and seals can be increased by laterally repositioning or urging the metering plate in the direction shown by the arrow.

Figure 10:
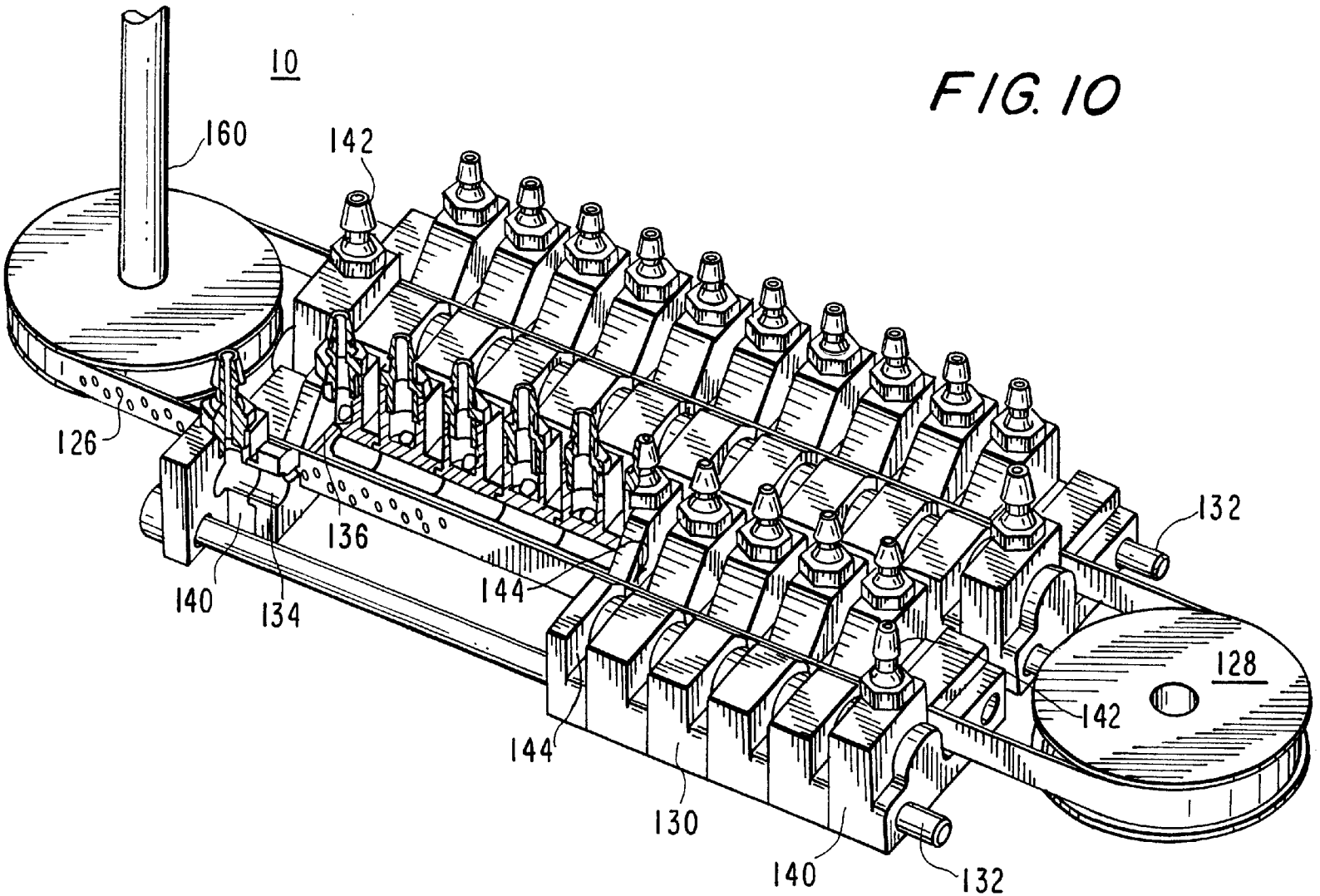
FIG. 10 is a perspective view of yet another construction for the invention.

FIG. 10 depicts an embodiment of the present invention utilizing a metering plate in the form of a continuous ribbon or belt. As shown therein, the metering apparatus 10 includes an endless loop metering plate 124 in which the apertures 126 are located. The metering plate is driven by a drive pulley 160. An idler pulley 128 is located at an opposed end of the apparatus. A series of monoblock sections are mounted on support rails 132 located such that the metering plate 124 passes through a slot in each of the monoblocks. The entire apparatus is submerged in a reservoir of the oil to be metered. The metering plate may be either of constant thickness or may be wedge-shaped across its width with a correspondingly-shaped monoblock slot in the manner of FIG. 9A.

Each monoblock includes an inlet air passageway leading to a first fitting extending from a first side of the slot and in contact with a first side of the metering plate, and an outlet air/oil passageway 136 leading from a second fitting extending from a second side of the slot in contact with a second side of the metering plate to an upwardly-extending outlet barb 138. A portion of the inlet passageways may align with the corresponding passageways of adjacent monoblocks to form a continuous inlet path coupled to one or more inlet blocks 140 having inlet barbs 142 coupled to a compressed air supply. Each of the monoblocks may include a spacer portion 144 which establishes a transverse gap which exposes the metering plate to the oil in which the apparatus is submerged to allow the apertures to be refilled with oil as they pass from monoblock to monoblock.

The modular nature of the embodiment allows the number of monoblocks, and thus the number of discrete lubrication lines, to be modified as required. The monoblocks may be accommodated along either of the parallel sections of the metering plate, with means (not shown) to clamp them into end-to-end contact to establish a leak-free continuity of inlet passageway in fluid communication with one or more of the inlet blocks 140.

In addition to the size of the metering plate apertures and the motion of the metering plate influencing the liquid delivery characteristics of the present invention, the shape of the apertures and their relationship to the size of the fitting apertures also can effect operation. As depicted in FIG. 3, for example, the metering plate 36 has circular apertures 46 arranged in a staggered pattern which aligns with a larger circular passageway face in at least one outlet fitting 44. Such an arrangement provides a constant carrier fluid flow as the apertures cross the passageway. With the single circle aperture arrangement and passageway relationship shown in FIG. 3D, an increased dwell of an aligned aperture resulting from a stepped metering plate motion can minimize the effects of transition periods.

Figure 7:
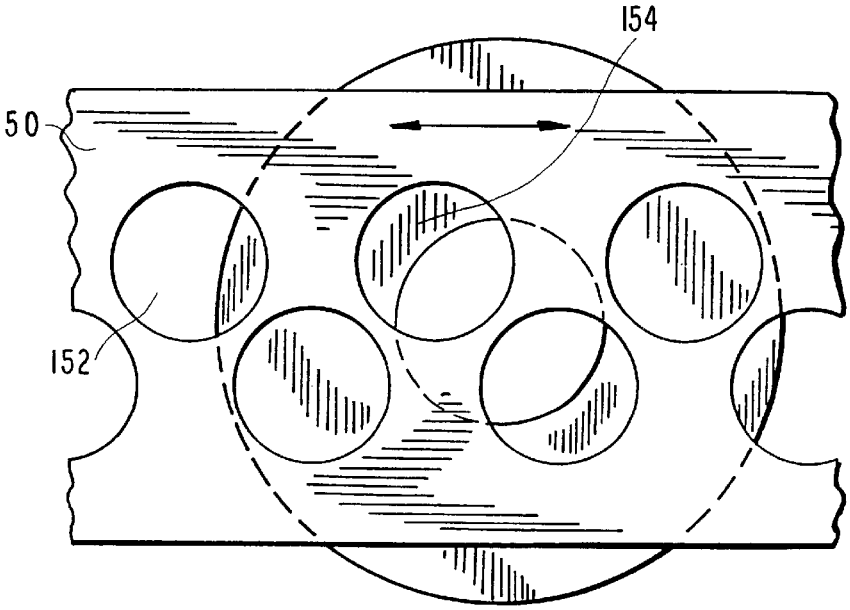
FIG. 7 is a depiction of another alternative for a metering plate and manifold.

FIGS. 4, 5 and 7 present alternative aperture arrangements, illustrated in connection with a rectangular metering plate 50 having a single row or line of apertures. It is to be appreciated that analogous or similar modifications can be made to the apertures in a rotating type of metering disk. As depicted in FIG. 4, the outlet fitting passageways 146 provided in the manifold may be of an elongated shape, whereby a plurality of the metering bores 148 are simultaneously aligned therewith. This can allow for a greater volume of lubricant and drive gas to be transmitted with each alignment. When multiple bores are to be simultaneously aligned in a linear system, the reciprocation distance must be correspondingly increased to insure that all of the apertures are re-exposed to the lubricant before they again pass into alignment with the fittings. Similar spacing considerations must also be considered when a disk-like metering plate is utilized.

FIG. 5 depicts an alternative in. which triangular, rather than circular, cross-section metering bores 150 are utilized. In such a case, the outlet manifold fittings may utilize a corresponding square or rectangular alignment opening 152.

The configuration shown in FIG. 7 utilizes a staggered arrangement of metering plate apertures 152 in conjunction with a larger outlet fitting bore 154 in which at least two apertures are at least partially simultaneously aligned with the outlet bore at any time. Flow characteristics of the oil will allow the entire aperture contents to be exhausted notwithstanding the partial alignment. This alignment is similar to that depicted for the rotating disc metering plates of FIG. 3.

A variety of materials may be used for the metering plate, depending on the plate's specific configuration. In addition to rigid materials, such as metal or plastic for disk or elongated forms, the belt-like metering plate as illustrated in FIG. 10 may be constructed of thick fabrics, foam, or the like. Other variations, adaptations and modifications to the invention may also be apparent to those skilled in the art and are intended to be embraced by the present invention.

I claim:

1. An apparatus for delivering metered amounts of a first fluid to a remote location, comprising:

a metering plate having at least one fluid receptacle extending between first and second surface portions of the plate for receipt of a measured amount of the first fluid;

a first port providing a source of a carrier fluid and having an end in contact with the first plate surface portion;

a second port connected to a fluid delivery line to the remote location and having an end in contact with the second plate surface portion, the ends of the ports being positioned to simultaneously communicate with a receptacle when the metering plate is in a transfer position whereby the carrier fluid may pass from the first port through the receptacle into the second port and fluid delivery line to transfer first fluid from the aperture to the fluid delivery line and carry first fluid along the fluid delivery line to the remote location; and drive means coupled to said metering plate for alternating the position of the metering plate between a position wherein a fluid receptacle is directly exposed to a supply of the first fluid in a reservoir whereby the first fluid fills the fluid receptacle with the measured amount of the first fluid, and a transfer position.

2. The apparatus of claim 1, wherein the first and second surface portions are portions of a single surface.

3. The apparatus of claim 1, wherein the first and second surface portions are portions of different surfaces.

4. The apparatus of claim 1 wherein said metering plate and said ports are submerged in the reservoir.

5. The apparatus of claim 1 wherein said first ports are mounted to an inlet manifold and said second fittings are mounted to an outlet manifold.

6. The apparatus of claim 1 wherein the fluid receptacle is in the form of a bore extending between the first and second plate surfaces.

7. The apparatus of claim 6, wherein the bore is of a constant cross-sectional area.

8. The apparatus of claim 6, wherein the bore is of a varying cross-sectional area.

9. The apparatus of claim 6, wherein the end of the second fitting has a opening of greater cross-sectional area than a cross-sectional area of the bore at the second plate surface.

10. The apparatus of claim 5, wherein the metering plate is in the form of a disc.

11. The apparatus of claim 3, wherein said inlet and outlet ports each comprise fittings projecting for the respective manifolds.

12. The apparatus of claim 1, wherein the metering plate is an elongated plate.

13. The apparatus of claim 12, wherein the elongated plate is of tapered thickness across a width of the plate.

14. The apparatus of claim 1, wherein the metering plate is an endless loop.

15. The apparatus of claim 14, wherein the endless loop is of tapered thickness across a width of the loop.

16. The apparatus of claim 1, wherein the metering plate is a truncated cone.

17. The apparatus of claim 10, wherein said drive means is coupled to rotate said disk about a central axis.

18. The apparatus of claim 12, wherein said drive means is coupled to the plate for reciprocation of the plate.

19. A method of dispensing a series of metered amounts of a first fluid comprising the steps of:

filling a receptacle in a metering plate having a volume corresponding to a metered amount of the fluid with the first fluid by immersing the receptacle within a volume of the first fluid;

locating the filled receptacle between a source of a drive fluid and a delivery conduit; and driving the first fluid in the receptacle into and through the delivery conduit by the drive fluid.

20. The method of claim 19, wherein the drive fluid is a compressed gas.

21. An apparatus for delivering metered amounts of a first fluid to remote locations, comprising:

a metering plate having at least one fluid receptacle extending between first and second surfaces of the plate for receipt of a measured amount of the first fluid;

at least one pair of first and second ports, the first ports each providing a source of a carrier fluid and having an end in contact with the first plate surface and the second ports each connected to a fluid delivery line to a remote location and having an end in contact with the second plate surface, the ends of the first and second ports of a port pair being positioned to simultaneously communicate with a receptacle when the metering plate is in a transfer position whereby the carrier fluid may pass from the first fitting in communication through the receptacle into the second fitting in communication and the associated fluid delivery line to transfer first fluid from the receptacle to the associated fluid delivery line and carry previously transferred first fluid along the fluid delivery line to the remote location; and drive means coupled to said metering plate for alternating the position of the metering plate between a position wherein a receptacle is directly exposed to a supply of the first fluid in a reservoir whereby the first fluid fills the fluid receptacle with the measured amount of the first fluid, and a transfer position.

22. An apparatus for transporting metered amounts of a first fluid to remote locations, comprising:

a metering plate having at least one fluid receptacle each having at least first and second ends each open to a surface of the plate for receipt of a measured amount of the first fluid;

at least one set of corresponding inlet and outlet ports, the inlet port of a set providing a source of a carrier fluid and having an end in contact with the plate surface having the first end of a particular receptacle, the outlet port of a set connected to a first fluid delivery line to a remote location and having an end in contact with the plate surface having the corresponding second end of the particular receptacle;

the ends of the inlet and outlet ports of a port set being positioned to simultaneously communicate with the first and second ends of the particular receptacle when the metering plate is in a first fluid transfer position whereby the carrier fluid may pass from the positioned inlet port through the particular receptacle into the correspondingly positioned outlet port and associated first fluid delivery line to transfer first fluid from the particular receptacle to the associated fluid delivery line and carry previously transferred first fluid along the fluid delivery line to the remote location; and drive means coupled to said metering plate for alternating the position of the metering plate between a position wherein the particular fluid receptacle is directly exposed to a supply of first fluid in a reservoir whereby the first fluid fills the fluid receptacle with the measured amount of the first fluid, and a transfer position for the particular fluid receptacle.

* * * * *